US010854153B2

(12) United States Patent
Huang et al.

(10) Patent No.: US 10,854,153 B2
(45) Date of Patent: Dec. 1, 2020

(54) DRIVING VOLTAGE COMPENSATION METHOD, GRAY SCALE COMPENSATION METHOD AND DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventors: Pengcheng Huang, Hubei (CN); Wei Li, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/320,369

(22) PCT Filed: Jan. 11, 2019

(86) PCT No.: PCT/CN2019/071401
§ 371 (c)(1),
(2) Date: Jan. 24, 2019

(87) PCT Pub. No.: WO2020/077900
PCT Pub. Date: Apr. 23, 2020

(65) Prior Publication Data

US 2020/0126499 A1 Apr. 23, 2020

(30) Foreign Application Priority Data

Oct. 18, 2018 (CN) ..... 2018 1 1213745

(51) Int. Cl.
*G09G 3/36* (2006.01)

(52) U.S. Cl.
CPC ..... *G09G 3/3607* (2013.01); *G09G 3/3696* (2013.01); *G09G 3/3674* (2013.01);
(Continued)

(58) Field of Classification Search
CPC ..... G09G 3/3607; G09G 3/3696; G09G 2320/0673; G09G 2320/0276;
(Continued)

(56) References Cited

U.S. PATENT DOCUMENTS

2015/0187094 A1* 7/2015 Lee ..... G06T 5/009 345/590
2015/0302788 A1* 10/2015 Kim ..... G09G 3/2007 345/690

(Continued)

*Primary Examiner* — Xuemei Zheng
(74) *Attorney, Agent, or Firm* — Muncy, Geissler, Olds & Lowe, P.C.

(57) ABSTRACT

Provided are a driving voltage compensation method, a gray scale compensation method and a display device. In the methods, the voltage is divided into a plurality of ranges which are different. The different compensation rules are configured for different ranges, and the corresponding compensation parameters of each range can be obtained by using the test points in each range, such that the compensation effect is closer to the actual gamma curve, so as to alleviate the technical problem of uneven display of pixels in the display panel of the prior art, for increasing the product yield of the display device.

12 Claims, 5 Drawing Sheets

(52) U.S. Cl.
CPC ..... *G09G 2320/0233* (2013.01); *G09G 2320/0276* (2013.01)

(58) Field of Classification Search
CPC ... G09G 2320/0233; G09G 2320/0626; G09G 2320/0271; G09G 2360/144
See application file for complete search history.

(56) References Cited

U.S. PATENT DOCUMENTS

| | | | | |
|---|---|---|---|---|
| 2017/0249890 | A1* | 8/2017 | Yoo | G09G 3/2074 |
| 2019/0108780 | A1* | 4/2019 | Meng | G09G 3/20 |

* cited by examiner

DRIVING VOLTAGE COMPENSATION METHOD, GRAY SCALE COMPENSATION METHOD AND DISPLAY DEVICE

FIELD OF THE INVENTION

The present application relates to a display technology field, and more particularly to a driving voltage compensation method, a gray scale compensation method and a display device.

BACKGROUND OF THE INVENTION

With the development of display technology, the display effect of display products has been constantly improved, thereby making the display products more and more widely used. However, the existing display panel is likely to cause uneven illumination among pixels due to manufacturing processes and aging of the light emitting material. Namely, when different pixels are inputted with the same image signal (generally gray scale voltage), the luminous brightnesses are different, thus affecting the image display quality.

As regarding the foregoing phenomenon, the prior art uses a gamma curve to correct the driving gray scale voltage of the pixel, which specifically is: G=g+a, wherein G is the compensated driving gray scale voltage, and g is the corresponding gray scale voltage of the pixel in a content of the next frame image, and a is the fixed compensation value corresponding to the pixel (which can be tested according to various methods). This method alleviates the problem that the luminous brightnesses of different pixels are different when the different pixels are inputted with the same image signal g in a certain level. However, the compensation method uses linear compensation, and as shown in FIG. 4, the actual gamma curves are not all linearly changed, so the compensation method of the prior art cannot achieve a good compensation effect.

Therefore, how to compensate the pixels to alleviate the uneven display of the display panel has become an urgent problem to be solved.

SUMMARY OF THE INVENTION

The present application provides a driving voltage compensation method, a gray scale compensation method and a display device to alleviate technical problems of uneven display of pixels in a display panel of the prior art.

To solve the aforesaid problem, the technical solution of the present application is described as follows:

the embodiment of the present application provides a pixel driving voltage compensation method, comprising:

determining a gamma curve of a pixel, wherein the gamma curve is a corresponding curve of a driving voltage and a luminous brightness of the pixel;

dividing the driving voltage into at least two driving voltage ranges according to the gamma curve and determining test points in the respective driving voltage ranges; wherein driving voltage compensation rules corresponding to different driving voltage ranges are different;

determining corresponding brightness values of the driving voltages corresponding to the test points in the gamma curve;

obtaining actual driving voltages required when the luminous brightness of the pixel reaches the brightness values;

deriving driving voltage compensation parameters corresponding to the respective driving voltage ranges according to a mapping relationship between the driving voltages of the test points in the respective driving voltage ranges and the actual driving voltages, and the driving voltage compensation rules of the driving voltage ranges; and compensating the driving voltage of the pixel according to the driving voltage compensation parameters corresponding to the driving voltage ranges.

In an embodiment of the present application, the step of compensating the driving voltage of the pixel according to the driving voltage compensation parameters corresponding to the driving voltage ranges includes:

obtaining a home driving voltage range of a driving voltage of the pixel in a next frame image;

obtaining an actual driving voltage of the pixel in the next frame image according to a driving voltage compensation parameter corresponding to the home driving voltage range and the driving voltage of the pixel in the next frame image; and driving the pixel to emit light according to the actual driving voltage of the pixel in the next frame image.

In an embodiment of the present application, the step of determining the test points in the respective driving voltage ranges includes:

determining a number of compensation coefficients in the driving voltage ranges corresponding to the driving voltage compensation rules;

determining a number of the test points required according to the number of compensation coefficients; and setting the test points of a corresponding number in the drive voltage ranges.

In an embodiment of the present application, the step of obtaining the actual driving voltages required when the luminous brightness of the pixel reaches the brightness values includes:

gradually increasing the driving voltage of the pixel, and collecting the luminous brightness of the pixel in real time; and using corresponding driving voltages as the actual driving voltages required when the luminous brightness of the pixel reaches the brightness values.

In an embodiment of the present application, the step of compensating the driving voltage of the pixel according to the driving voltage compensation parameters corresponding to the driving voltage ranges includes:

obtaining a home driving voltage range of a driving voltage of the pixel in a next frame image;

obtaining an actual driving voltage of the pixel in the next frame image according to a driving voltage compensation parameter corresponding to the home driving voltage range and the driving voltage of the pixel in the next frame image; and driving the pixel to emit light according to the actual driving voltage of the pixel in the next frame image.

Meanwhile; the embodiment of the present application provides a display panel gray scale compensation method, including:

determining a gamma curve of a display panel, wherein the gamma curve is a corresponding curve of a gray scale voltage and a luminous brightness of the pixel;

dividing the gray scale voltage into at least two gray scale voltage ranges according to the gamma curve and determining test points in the respective gray scale voltage ranges; wherein gray scale voltage compensation rules corresponding to different gray scale voltage ranges are different;

determining corresponding brightness values of the gray scale voltages corresponding to the test points in the gamma curve;

obtaining actual gray scale voltages required when the luminous brightness of the pixel reaches the brightness values;

deriving gray scale voltage compensation parameters corresponding to the respective gray scale voltage ranges according to a mapping relationship between the gray scale voltages of the test points in the respective gray scale voltage ranges and the actual gray scale voltages, and the gray scale voltage compensation rules of the gray scale voltage ranges; and compensating the gray scale voltage of the pixel according to the gray scale voltage compensation parameters corresponding to the gray scale voltage ranges.

In an embodiment of the present application, the step of compensating the gray scale voltage of the pixel according to the gray scale voltage compensation parameters corresponding to the gray scale voltage ranges includes:

determining a theoretical gray scale voltage of the pixel when displaying a next frame image according to a content of the next frame image;

obtaining a belonged gray scale voltage range of the theoretical gray scale voltage;

obtaining an actual gray scale voltage corresponding to the theoretical gray scale voltage according to the gray scale compensation parameter corresponding to the belonged gray scale voltage range; and driving the pixel to emit light according to the actual gray scale voltage.

In an embodiment of the present application, the step of determining the test points in the respective gray scale voltage ranges includes:

determining a number of compensation coefficients in the gray scale voltage ranges corresponding to the gray scale voltage compensation rules;

determining a number of the test points required according to the number of compensation coefficients; and setting the test points of a corresponding number in the gray scale voltage ranges.

In an embodiment of the present application, the step of dividing the gray scale voltage into at least two gray scale voltage ranges according to the gamma curve includes:

determining a change trend of the gray scale voltage and the luminous brightness corresponding to the gamma curve; and sequentially dividing gray scale voltage into a first gray scale voltage range, a second gray scale voltage range and a third gray scale voltage range in an order from small to large.

In an embodiment of the present application, a gray scale compensation rule corresponding to the first gray scale voltage range is a quadratic function, and a gray scale compensation rule corresponding to the second gray scale voltage range is a linear function, and a gray scale compensation rule corresponding to the third gray scale voltage range is a quadratic function.

In an embodiment of the present application, the step of compensating the gray scale voltage of the pixel according to the gray scale voltage compensation parameters corresponding to the gray scale voltage ranges includes:

determining a theoretical gray scale voltage of the pixel when displaying a next frame image according to a content of the next frame image;

obtaining a belonged gray scale voltage range of the theoretical gray scale voltage;

obtaining an actual gray scale voltage corresponding to the theoretical gray scale voltage according to the gray scale compensation parameter corresponding to the belonged gray scale voltage range; and driving the pixel to emit light according to the actual gray scale voltage.

In an embodiment of the present application, the step of obtaining the actual gray scale voltages required when the luminous brightness of the pixel reaches the brightness values includes:

gradually increasing the gray scale voltage of the pixel, and collecting the luminous brightness of the pixel in real time; and using corresponding gray scale voltages as the actual gray scale voltages required when the luminous brightness of the pixel reaches the brightness values.

Meanwhile, the embodiment of the present application further provides a display device, including a display panel, a driving chip, a lighting module, a processor and a memory, wherein:

the processor is configured for determining a gamma curve of a display panel, wherein the gamma curve is a corresponding curve of a gray scale voltage and a luminous brightness of the pixel; dividing the gray scale voltage into at least two gray scale voltage ranges according to the gamma curve and determining test points in the respective gray scale voltage ranges; wherein gray scale voltage compensation rules corresponding to different gray scale voltage ranges are different; determining corresponding brightness values of the gray scale voltages corresponding to the test points in the gamma curve; wherein gray scale voltage compensation rules corresponding to different gray scale voltage ranges are different;

the lighting module is configured for collecting the luminous brightness of the pixel;

the driving chip is configured for driving the pixel in the display panel to emit light;

the processor is further configured for obtaining actual gray scale voltages required when the luminous brightness of the pixel reaches the brightness values;

deriving gray scale voltage compensation parameters corresponding to the respective gray scale voltage ranges according to a mapping relationship between the gray scale voltages of the test points in the respective gray scale voltage ranges and the actual gray scale voltages, and the gray scale voltage compensation rules of the gray scale voltage ranges, and storing the same to the memory;

the driving chip is further configured for driving the pixel in the display panel to emit light after compensating the gray scale voltage of the pixel according to the gray scale voltage compensation parameters corresponding to the gray scale voltage ranges; and the memory is configured for storing a program required to implement functions of the processor, the gray scale voltage ranges corresponding to the respective pixels, the gray scale compensation rules corresponding to the respective gray scale voltage ranges and the gray scale compensation parameters in at least one gamma curve.

In an embodiment of the present application, the light module includes a camera.

In an embodiment of the present application, the camera includes a charge-coupled device camera.

In an embodiment of the present application, the memory includes a flash memory.

In an embodiment of the present application, the memory stores a plurality of sets of data corresponding to gamma for each pixel, and each set of data includes scopes of the plurality of gray scale voltage ranges, the gray scale compensation rules corresponding to the respective gray scale voltage ranges and the gray scale compensation parameters.

In an embodiment of the present application, the display device further includes a gamma curve adjustment module, and the gamma curve adjustment module is configured for adjusting a gamma curve required by the driving chip to provide a gray scale of video signal according to a brightness change of a display device environment.

In an embodiment of the present application, the gamma curve adjustment module includes an ambient light processing unit and a gamma curve adjuster, and the ambient light processing unit is configured for sensing the brightness change of the display device environment and outputting a brightness signal, and the gamma curve adjuster is configured for finding a gamma curve corresponding to the brightness signal according to a built-in lookup table.

In an embodiment of the present application, the ambient light processing unit includes a light sensor and a light amplification processor, and the light sensor is configured for sensing the brightness change of the display device environment and outputting a light sensing signal, and the light amplification processor is configured for performing an optimization process on the light sensing signal to obtain the brightness signal.

The benefits of the present application are: the present application provides a new driving voltage compensation method, a gray scale compensation method and a display device. In the methods, the driving voltage or the gray scale voltage is divided into a plurality of driving voltage ranges or gray scale voltage ranges which are different. The different compensation rules are configured for different ranges, and the corresponding compensation parameters of each range can be obtained by using the test points in each range. In the subsequent compensation, the corresponding compensation parameters are determined according to the driving voltage or gray scale voltage required to be output, and then the compensated driving voltages or the compensated gray scale voltages are obtained based on the compensation parameters to drive the pixels to emit light, such that the compensation effect is closer to the actual gamma curve, so as to alleviate the technical problem of uneven display of pixels in the display panel of the prior art, for increasing the product yield of the display device and improving the user experience.

BRIEF DESCRIPTION OF THE DRAWINGS

In order to more clearly illustrate the embodiments of the present invention and the prior art, the following figures will be described in the embodiments and the prior art are briefly introduced. It is obvious that the drawings are only some embodiments of the present invention, those of ordinary skill in this field can obtain other figures according to these figures without paying the premise.

DETAILED DESCRIPTION OF PREFERRED EMBODIMENTS

Figure 1:
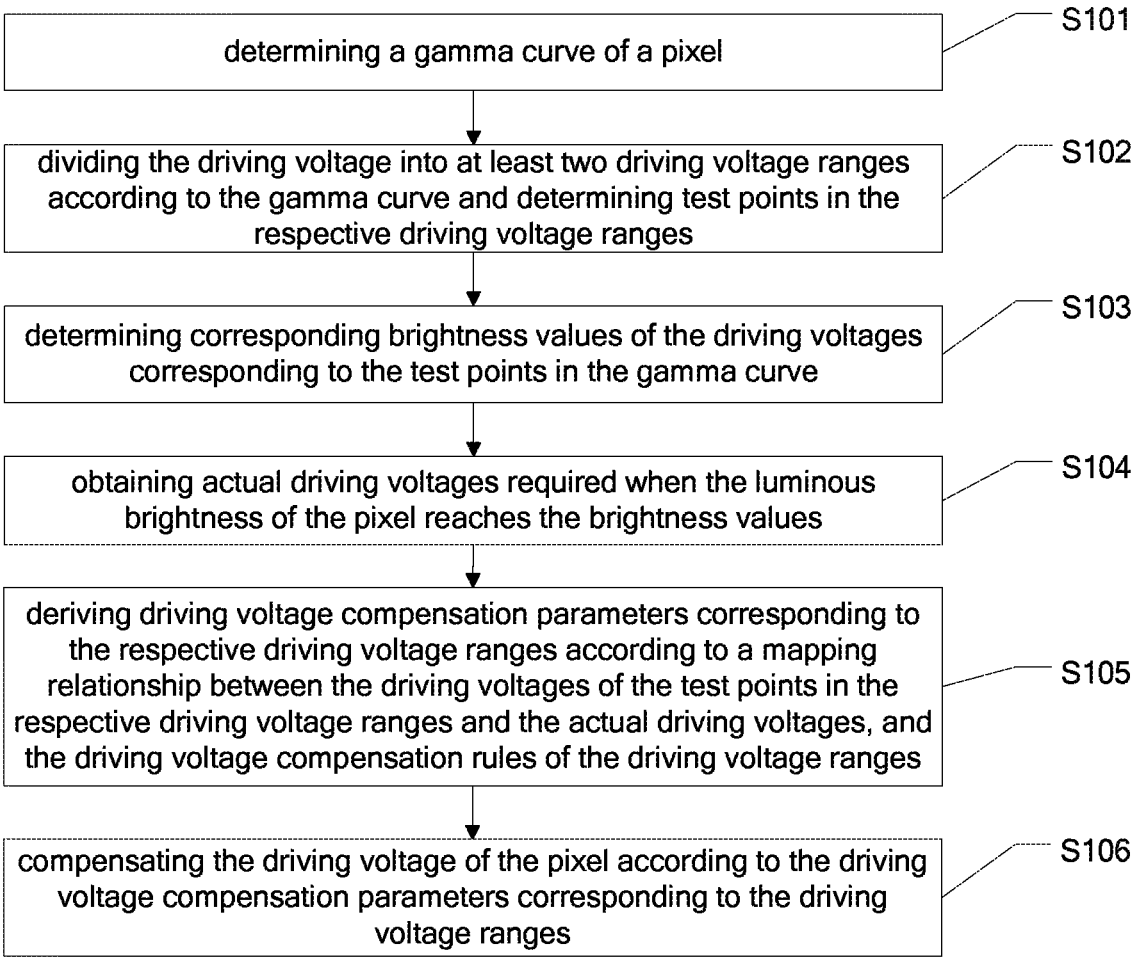
FIG. 1 is a flowchart of a driving voltage compensation method according to an embodiment of the present application.

The following descriptions for the respective embodiments are specific embodiments capable of being implemented for illustrations of the present application with referring to appended figures. The terms of up, down, front, rear, left, right, interior, exterior, side, etcetera mentioned in the present application are merely directions of referring to appended figures. Thus, the used directional terms are used to describe and understand the present application, but the present invention is not limited thereto. In the figure, units with similar structures are denoted by the same reference numerals.

The present application can solve the defect in that the existing compensation method adopts linear compensation and the actual gamma curve does not conform to the technical problem caused by the poor compensation effect.

As shown in FIG. 1, the pixel driving voltage compensation method according to the present application includes steps of:

S101, determining a gamma curve of a pixel.

The gamma curve is a corresponding curve of a driving voltage and a luminous brightness of the pixel; the formula for the gamma curve is:

$$Lx=(x/z)^{y}\times Lz;$$

wherein x is the driving voltage, and Lx is the corresponding luminous brightness when the driving voltage of the pixel is x, and z is the maximum driving voltage, and Lz is the corresponding luminous brightness when the driving voltage of the pixel is the maximum driving voltage z, and y is the target gamma value of the display panel. In an embodiment, the target gamma value may be set to 2.2, and may also be set according to user requirements, and is not specifically limited.

Figure 4:
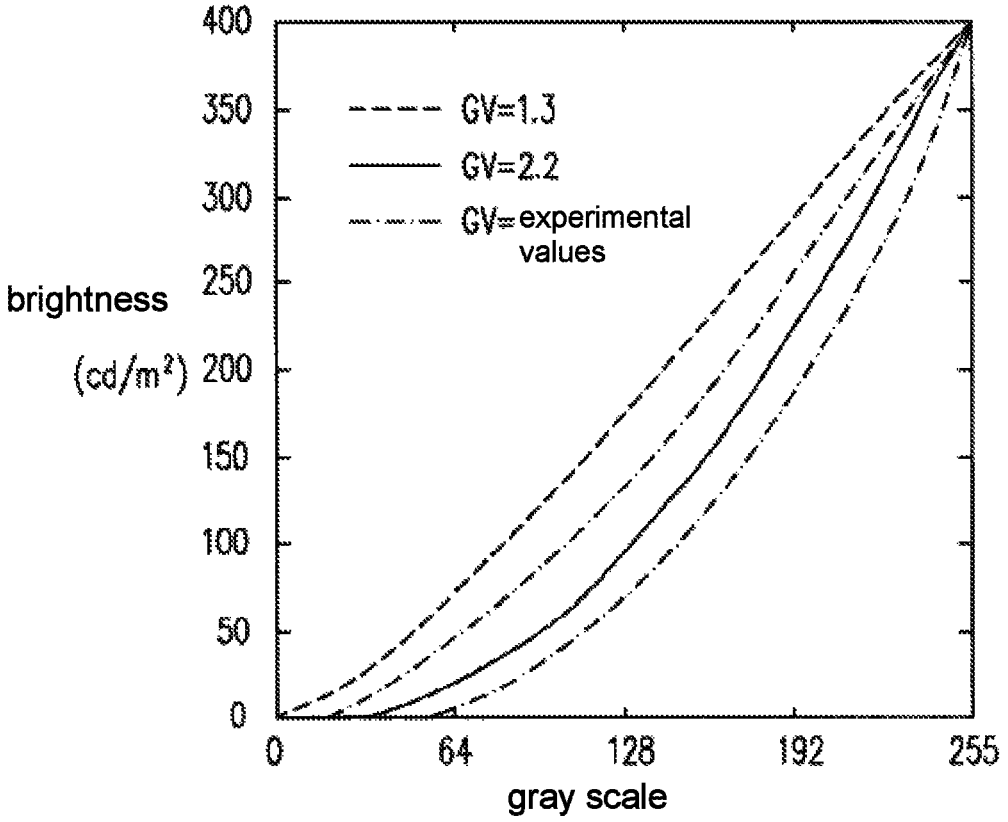
FIG. 4 is a diagram of a gamma curve provided by an embodiment of the present application.

As shown in FIG. 4, the horizontal axis represents the gray scale (gray level) of the video signal, and the vertical axis represents the brightness (cd/m2). In the four tone gamma curves disclosed in FIG. 4, the gamma value of the tone gamma curve of the solid line (---) is 2.2, and the gamma value of the tone gamma curve of the dotted line (--) is 1.3, and the gamma value of the tone gamma curve of the dotted line (-.-) is based on experimental values obtained from cumbersome experiments (for instance, 2.0, 1.8), wherein the experimental value should be determined according to the actual situation, and thus not limited here.

In an embodiment, a number of the aforesaid tone gamma curves may be relatively increased or decreased according to actual requirements.

Lz can be obtained in the following:

first, the display chromaticity and the display brightness of each group of red sub-pixels, green sub-pixels and blue sub-pixels of the OLED display panel when the inputted driving voltage is z are obtained;

the white target chromaticity value and the white target brightness value are obtained;

the target display brightness when the driving voltage of each group of red sub-pixels, green sub-pixels and blue sub-pixels of the OLED display panel is z is calculated according to a colorimetric formula.

Specifically, one red sub-pixel, one blue sub-pixel and one green sub-pixel form a group of sub-pixels, that is, a pixel is formed. According to the colorimetric formula, the target display brightness when the driving voltage of each sub-pixel in each pixel is z can be obtained. In this embodiment, according to the white target chromaticity value and the white target brightness value, combined with the colorimetric formula, the target display brightness when the driving voltage of each group of red sub-pixels, green sub-pixel and blue sub-pixels is z is calculated. While the illumination among the pixels is uneven, the white balance of the OLED display panel can be adjusted to eliminate the color shift of the OLED display panel.

Different display devices, such as mobile phones, display screens, televisions, etc., have different gamma curves; the same display device may have different gamma curves in different scenes, such as different illuminations (indoor, outdoor, etc.), so this step determines a gamma curve, first.

S102, dividing the driving voltage into at least two driving voltage ranges according to the gamma curve and determining test points in the respective driving voltage ranges.

In an embodiment, a number of driving voltage ranges can be infinitely large, so that the gamma curve is approximately linear in each driving voltage range, which makes the compensation effect more accurate.

In an embodiment, the driving voltage compensation rules corresponding to different driving voltage ranges are different.

In an embodiment, for reducing the calculation loading, the driving voltage is simply divided into three ranges. Then, dividing the driving voltage into at least two driving voltage ranges according to the gamma curve in this step includes:

determining a change trend of the driving voltage and the luminous brightness corresponding to the gamma curve; and sequentially dividing gray scale voltage into a first driving voltage range, a second driving voltage range and a third driving voltage range in an order from small to large.

In an embodiment, a compensation rule corresponding to the first driving voltage range is a quadratic function, and a compensation rule corresponding to the second driving voltage range is a linear function, and a compensation rule corresponding to the third driving voltage range is a quadratic function.

In an embodiment; determining test points in the respective driving voltage ranges in this step includes:

determining a number of compensation coefficients in the driving voltage ranges corresponding to the driving voltage compensation rules;

determining a number of the test points required according to the number of compensation coefficients; and setting the test points of a corresponding number in the drive voltage ranges.

For instance, the compensation rule corresponding to some driving voltage range, which is a quadratic function is illustrated as:

$$G=a1\times g^2+b1\times g+c1;$$

G is the compensated driving voltage; and g is the corresponding driving voltage of the pixel in a content of the next frame image, and a1, b1 and c1 are compensation parameters.

For this range, a number of the corresponding compensation parameters is 3; and then three or more test points can be set in this range. In an embodiment, the test points can be evenly distributed in the drive voltage range.

In an embodiment, for reducing the number of the test points and speeding the calculation; the end points of the driving voltage range may be considered to be the test points. Then, adjacent driving voltages may share such test points.

S103, determining corresponding brightness values of the driving voltages corresponding to the test points in the gamma curve.

This step can be obtained based on the gamma curve measurement, or can be calculated according to the formula corresponding to the gamma curve, and will not be described herein.

S104, obtaining actual driving voltages required when the luminous brightness of the pixel reaches the brightness values.

In an embodiment, this step includes:

gradually increasing the driving voltage of the pixel, and collecting the luminous brightness of the pixel in real time; and using corresponding driving voltages as the actual driving voltages required when the luminous brightness of the pixel reaches the brightness values.

S105, deriving driving voltage compensation parameters corresponding to the respective driving voltage ranges according to a mapping relationship between the driving voltages of the test points in the respective driving voltage ranges and the actual driving voltages, and the driving voltage compensation rules of the driving voltage ranges.

This step is a conventional clustering and fitting, which will be specifically described below.

S106, compensating the driving voltage of the pixel according to the driving voltage compensation parameters corresponding to the driving voltage ranges.

In an embodiment, this step includes:

obtaining a home driving voltage range of a driving voltage of the pixel in a next frame image;

obtaining an actual driving voltage of the pixel in the next frame image according to a driving voltage compensation parameter corresponding to the home driving voltage range and the driving voltage of the pixel in the next frame image; and driving the pixel to emit light according to the actual driving voltage of the pixel in the next frame image.

In an embodiment, the method shown in FIG. 1 further includes the following steps:

adjusting a gamma curve required to provide a gray scale of video signal according to a brightness change of a display device environment.

In an embodiment, the step of adjusting the gamma curve required to provide the gray scale of video signal according to the brightness change of the display device environment includes:

sensing the brightness change of the display device environment and outputting a brightness signal; and finding a gamma curve corresponding to the brightness signal according to a built-in lookup table.

In an embodiment, the step of sensing the brightness change of the display device environment and outputting the brightness signal includes:

sensing the brightness change of the display device environment and outputting a light sensing signal with a light sensor; and performing an optimization process on the light sensing signal to obtain the brightness signal with a light amplification processor.

Correspondingly, the embodiment of the present application provides a display device, including a display panel and a processor, wherein the display panel includes a plurality of pixels, wherein the processor is configured for determining a gamma curve of a pixel and dividing the driving voltage into at least two driving voltage ranges according to the gamma curve and determining test points in the respective driving voltage ranges; determining corresponding brightness values of the driving voltages corresponding to the test points in the gamma curve; obtaining actual driving voltages required when the luminous brightness of the pixel reaches the brightness values; deriving driving voltage compensation parameters corresponding to the respective driving voltage ranges according to a mapping relationship between the driving voltages of the test points in the respective driving voltage ranges and the actual driving voltages, and the driving voltage compensation rules of the driving voltage ranges; and compensating the driving voltage of the pixel according to the driving voltage compensation parameters corresponding to the driving voltage ranges.

In an embodiment, the processor is specifically configured to: obtaining a home driving voltage range of a driving voltage of the pixel in a next frame image; obtaining an actual driving voltage of the pixel in the next frame image according to a driving voltage compensation parameter corresponding to the home driving voltage range and the driving voltage of the pixel in the next frame image; and driving the pixel to emit light according to the actual driving voltage of the pixel in the next frame image.

In an embodiment, the processor is specifically configured to: determining a number of compensation coefficients in the driving voltage ranges corresponding to the driving voltage compensation rules; determining a number of the test points required according to the number of compensation coefficients; and setting the test points of a corresponding number in the drive voltage ranges.

The present application provides a new driving voltage compensation method and a display device. In the method, the driving voltage is divided into a plurality of driving voltage ranges which are different. The different compensation rules are configured for different ranges, and the corresponding compensation parameters of each range can be obtained by using the test points in each range. In the subsequent compensation, the corresponding compensation parameters are determined according to the driving voltage required to be output, and then the compensated driving voltages are obtained based on the compensation parameters to drive the pixels to emit light, such that the compensation effect is closer to the actual gamma curve, so as to alleviate the technical problem of uneven display of pixels in the display panel of the prior art, for increasing the product yield of the display device and improving the user experience.

Now, the driving voltage has 255 gray scales and the gamma is 2.2 as an illustration. In one embodiment, the driving voltage can be the gray scale of any number, and the gamma is an arbitrary value greater than 1.

Figure 2:
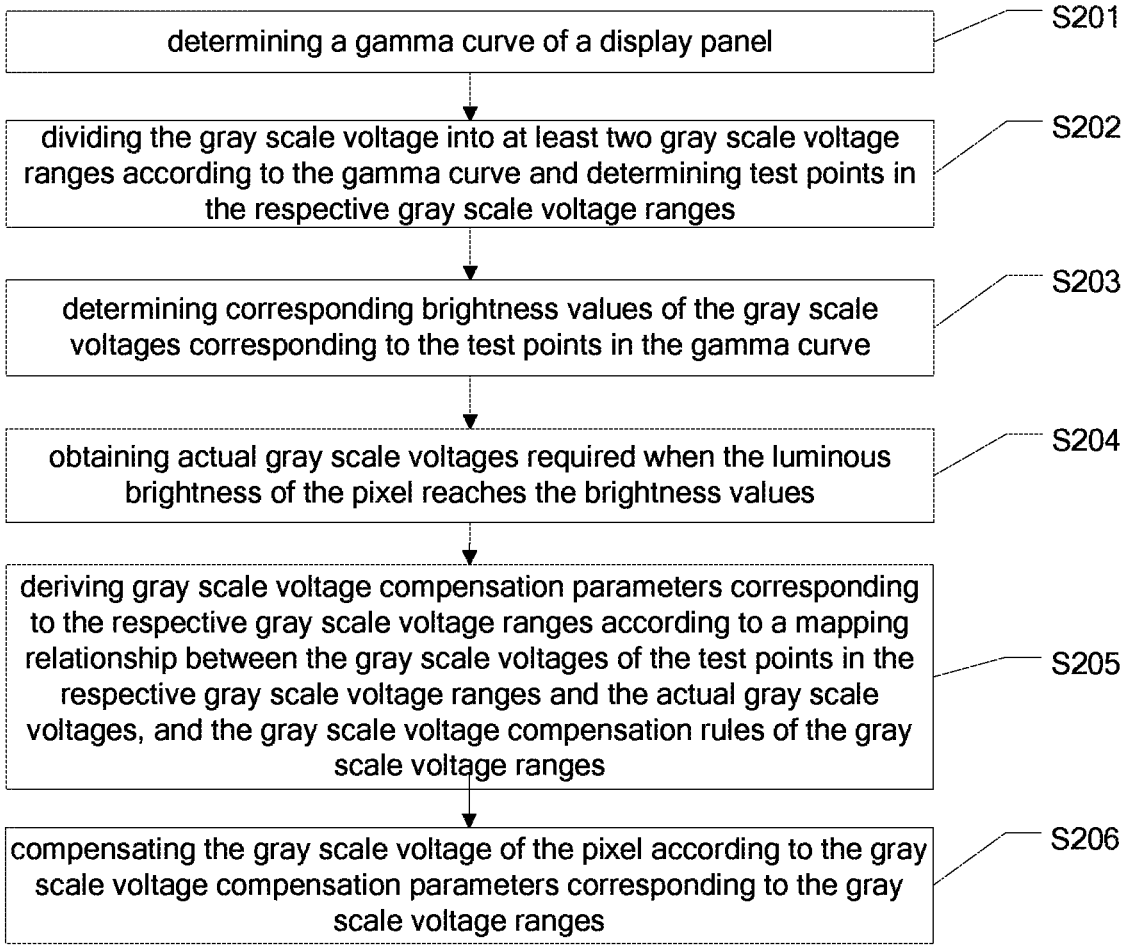
FIG. 2 is a flowchart of a gray scale compensation method according to an embodiment of the present application.

As shown in FIG. 2, the display panel gray scale compensation provided by the present application comprises the following steps;

S201, determining a gamma curve of a display panel.

The gamma curve is a corresponding curve of a gray scale voltage and a luminous brightness of the pixel.

Figure 5:
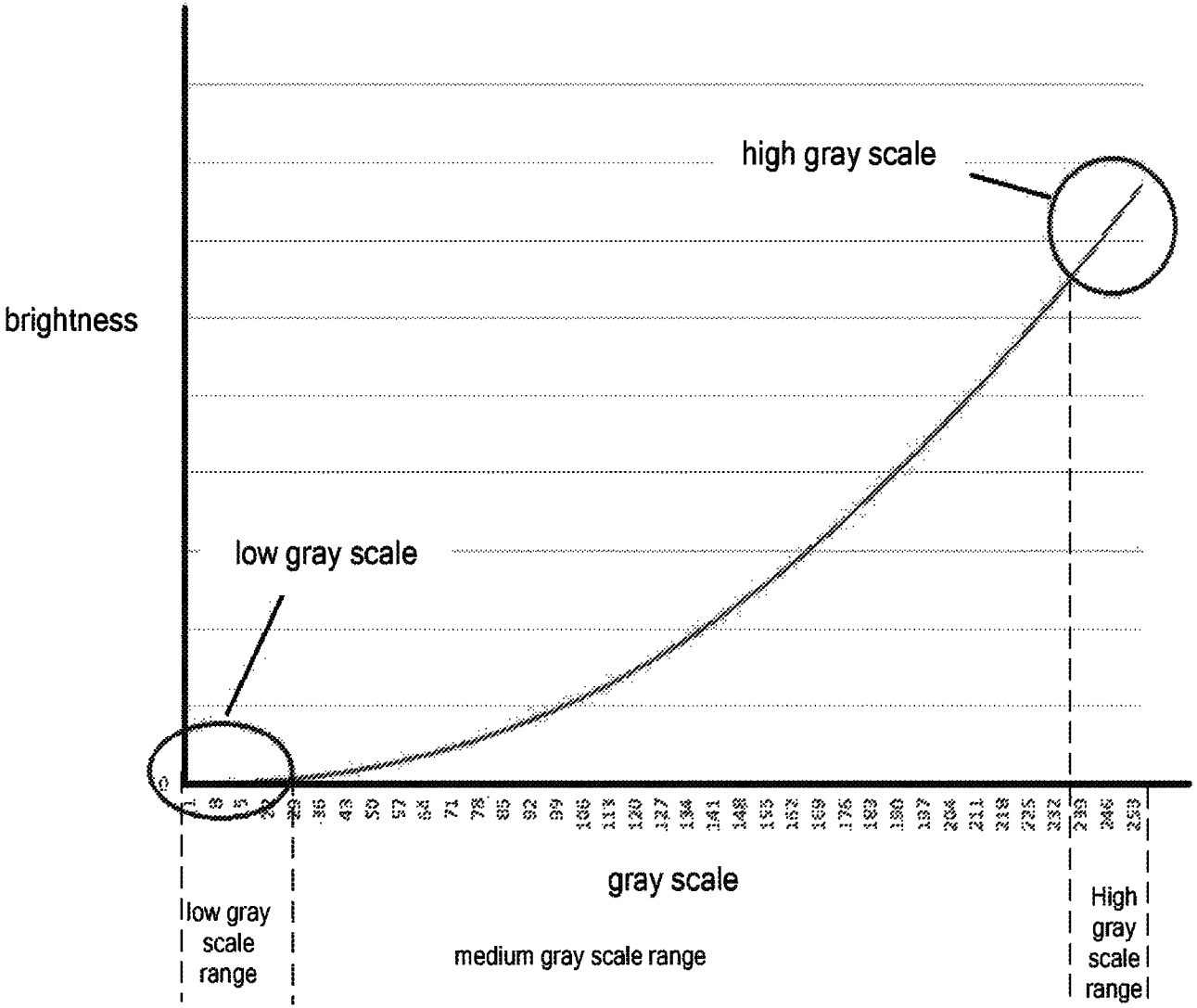
FIG. 5 is a diagram of gray scale voltage division according to an embodiment of the present application.

As shown in FIG. 5, the gamma curve is a curve with a gamma of 2.2.

S202, dividing the gray scale voltage into at least two gray scale voltage ranges according to the gamma curve and determining test points in the respective gray scale voltage ranges.

Gray scale voltage compensation rules corresponding to different gray scale voltage ranges are different.

In an embodiment, this step includes: determining a change trend of the gray scale voltage and the luminous brightness corresponding to the gamma curve; and sequentially dividing gray scale voltage into a first gray scale voltage range, a second gray scale voltage range and a third gray scale voltage range in an order from small to large.

In an embodiment, a gray scale compensation rule corresponding to the first gray scale voltage range is a quadratic function, and a gray scale compensation rule corresponding to the second gray scale voltage range is a linear function, and a gray scale compensation rule corresponding to the third gray scale voltage range is a quadratic function.

In an embodiment, this step includes: determining a number of compensation coefficients in the gray scale voltage ranges corresponding to the gray scale voltage compensation rules; determining a number of the test points required according to the number of compensation coefficients; and setting the test points of a corresponding number in the gray scale voltage ranges.

As shown in FIG. 5, the gray scale voltage of 225 is divided into a low gray scale range (1 to 30 gray scales, corresponding to the first gray scale range), a medium gray scale range (30 to 237 gray scales, corresponding to the second gray scale range) and a high gray scale range (237 to 255 gray scales, corresponding to the third gray scale range).

The gray scale compensation rule corresponding to the low gray scale range is:

$$G=a1\times g^2+b1\times g+c1;$$

the gray scale compensation rule corresponding to the high gray scale range is:

$$G=a2\times g^2+b2\times g+c2;$$

the gray scale compensation rule corresponding to the medium gray scale range is:

$$G=a3\times g+b3;$$

wherein G is the compensated driving voltage, and g is the corresponding driving voltage of the pixel in the content of the next frame image, and a1, b1, c1, a2, b2, c2, a3 and b3 are compensation parameters.

Meanwhile, six test points x1, x2, x3, x4, x5 and x6 are set, wherein the gray scale voltage g3 corresponding to x3 is 30, and the gray scale voltage g4 corresponding to x4 is 237. The gray scale voltage corresponding to x1 is g1 and the gray scale voltage corresponding to x2 is g2, which are both located in the low gray scale range. The gray scale voltage corresponding to x5 is g5 and the gray scale voltage corresponding to x6 is g6, which are both located in the high gray scale range.

S203, determining corresponding brightness values of the gray scale voltages corresponding to the test points in the gamma curve.

For the six test points, the corresponding brightness values are determined, respectively.

For instance, the gray scale voltage g1 of the test point x1 corresponds to L1 and the gray scale voltage g2 of the test point x2 corresponds to L2, and the gray scale voltage g3 of the test point x3 corresponds to L3, and the gray scale voltage g4 of the test point x4 corresponds to the gray scale of the L4, and the gray scale voltage g5 of the test point x5 corresponds to the gray scale of the L5, and the gray scale voltage g6 of the test point x6 corresponds to the gray scale of the L6.

S204, obtaining actual gray scale voltages required when the luminous brightness of the pixel reaches the brightness values.

In an embodiment, this step includes:

gradually increasing the gray scale voltage of the pixel, and collecting the luminous brightness of the pixel in real time; and using corresponding gray scale voltages as the actual gray scale voltages required when the luminous brightness of the pixel reaches the brightness values.

For instance, when the luminous brightness of the pixel reaches L1, the corresponding gray scale voltage is G1, and when the luminous brightness of the pixel reaches L2, the corresponding gray scale voltage is G2, and when the luminous brightness of the pixel reaches L3, the corresponding gray scale voltage is G3, and when the luminous brightness of the pixel reaches L4, the corresponding gray scale voltage is G4, and when the luminous brightness of the pixel reaches L5, the corresponding gray scale voltage is G5, and when the luminous brightness of the pixel reaches L6, the corresponding gray scale voltage is G6.

S205, deriving gray scale voltage compensation parameters corresponding to the respective gray scale voltage ranges according to a mapping relationship between the gray scale voltages of the test points in the respective gray scale voltage ranges and the actual gray scale voltages, and the gray scale voltage compensation rules of the gray scale voltage ranges.

Specifically, the mapping relationship between the gray scale voltage and the actual gray scale voltage of the test point x1 is g1-G1, and the mapping relationship between the gray scale voltage and the actual gray scale voltage of the test point x2 is g2-G2, and the mapping relationship between the gray scale voltage and the actual gray scale voltage of the test point x3 is g3-G3, and the mapping relationship between the gray scale voltage and the actual gray scale voltage of the test point x4 is g4-G4, and the mapping relationship between the gray scale voltage and the actual gray scale voltage of the test point x5 is g5-G5, and the mapping relationship between the gray scale voltage and the actual gray scale voltage of the test point x6 is g6-G6.

For the low gray scale range, g1-G1, g2-G2 and g3-G3 are substituted into the following formula:

$$G=a1\times g^2+b1\times g+c1;$$

a1, b1, c1 can be calculated;

for the high gray scale range, g4-G4, g5-G5 and g6-G6 are substituted into the following formula:

$$G=a2\times g^2+b2\times g+c2;$$

a2, b2; c2 can be calculated;

for the medium gray scale range, g3-G3 and g4-G4 are substituted into the following formula:

$$G=a3\times g+b3;$$

a3 and b3 can be calculated.

S206, compensating the gray scale voltage of the pixel according to the gray scale voltage compensation parameters corresponding to the gray scale voltage ranges.

In an embodiment, this step includes:

determining a theoretical gray scale voltage of the pixel when displaying a next frame image according to a content of the next frame image;

obtaining a belonged gray scale voltage range of the theoretical gray scale voltage;

obtaining an actual gray scale voltage corresponding to the theoretical gray scale voltage according to the gray scale compensation parameter corresponding to the belonged gray scale voltage range; and driving the pixel to emit light according to the actual gray scale voltage.

For instance; in case that the display device needs to display a certain frame image, the gray scale voltage corresponding to a certain pixel is g7 (the image content can be obtained by analyzing the image). Then, a belonged gray scale voltage range of g7 is determined, such as the low gray scale range, and then the actual gray scale voltage G7 corresponding to the theoretical gray scale voltage is obtained according to the gray scale compensation parameters a1, b1, c1 corresponding to the belonged gray scale voltage range. Finally, the pixel is driven to emit light based on the actual gray scale voltage G7.

In an embodiment; the method shown in FIG. 2 further includes the following steps:

adjusting a gamma curve required to provide a gray scale of video signal according to a brightness change of a display device environment.

In an embodiment, the step of adjusting the gamma curve required to provide the gray scale of video signal according to the brightness change of the display device environment includes:

sensing the brightness change of the display device environment and outputting a brightness signal; and finding a gamma curve corresponding to the brightness signal according to a built-in lookup table.

In an embodiment, the step of sensing the brightness change of the display device environment and outputting the brightness signal includes:

sensing the brightness change of the display device environment and outputting a light sensing signal with a light sensor; and performing an optimization process on the light sensing signal to obtain the brightness signal with a light amplification processor.

The embodiment of the present application provides a new gray scale compensation method. In the method, the gray scale voltage is divided into a plurality of gray scale voltage ranges which are different. The different compensation rules are configured for different ranges, and the corresponding compensation parameters of each range can be obtained by using the test points in each range. In the subsequent compensation, the corresponding compensation parameters are determined according to the gray scale voltage required to be output, and then the compensated gray scale voltages are obtained based on the compensation parameters to drive the pixels to emit light, such that the compensation effect is closer to the actual gamma curve, so as to alleviate the technical problem of uneven display of pixels in the display panel of the prior art and to improve the display effect of the display, for increasing the product yield of the display device and improving the user experience.

Figure 3:
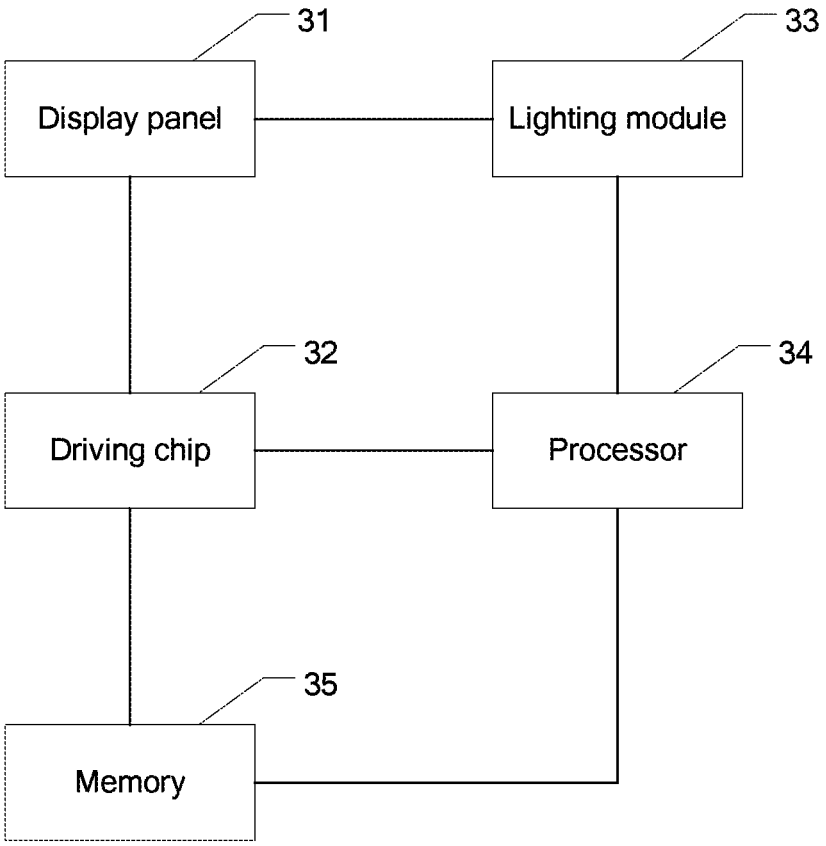
FIG. 3 is a diagram of a display device according to an embodiment of the present application.

As shown in FIG. 3, the display device provided by the present application includes: a display panel 31, a driving chip 32, a lighting module 33, a processor 34 and a memory 35, wherein:

the display panel 31 includes a plurality of pixels;

the driving chip 32 is configured for driving the pixel in the display panel 31 to emit light;

the lighting module 33 is configured for collecting the luminous brightness of the pixel;

the processor 34 is configured for determining a gamma curve of a display panel 31, wherein the gamma curve is a corresponding curve of a gray scale voltage and a luminous brightness of the pixel; dividing the gray scale voltage into at least two gray scale voltage ranges according to the gamma curve and determining test points in the respective gray scale voltage ranges; wherein gray scale voltage compensation rules corresponding to different gray scale voltage ranges are different; determining corresponding brightness values of the gray scale voltages corresponding to the test points in the gamma curve; wherein gray scale voltage compensation rules corresponding to different gray scale voltage ranges are different;

the processor 34 is further configured for obtaining actual gray scale voltages required when the luminous brightness of the pixel reaches the brightness values;

deriving gray scale voltage compensation parameters corresponding to the respective gray scale voltage ranges according to a mapping relationship between the gray scale voltages of the test points in the respective gray scale voltage ranges and the actual gray scale voltages, and the gray scale voltage compensation rules of the gray scale voltage ranges, and storing the same to the memory;

the driving chip 32 is further configured for driving the pixel in the display panel to emit light after compensating the gray scale voltage of the pixel according to the gray scale voltage compensation parameters corresponding to the gray scale voltage ranges; and the memory 35 is configured for storing a program required to implement functions of the processor, the gray scale voltage ranges corresponding to the respective pixels, the gray scale compensation rules corresponding to the respective gray scale voltage ranges and the gray scale compensation parameters in at least one gamma curve.

In an embodiment, the memory 35 is a flash memory that speeds up data access.

In an embodiment, the memory 35 stores a plurality of sets of data corresponding to gamma for each pixel, and each set of data includes scopes of the plurality of gray scale voltage ranges, the gray scale compensation rules corresponding to the respective gray scale voltage ranges and the gray scale compensation parameters.

In an embodiment, the lighting module includes a camera, such as a Charge-coupled Device (CCD) camera, and the display image of the OLEO display panel is acquired by using the CCD camera, and the display brightness of each sub-pixel can be obtained to improve the brightness adjustment accuracy.

The embodiment of the present application provides a display device. The gray scale voltage is divided into a plurality of gray scale voltage ranges which are different. The different compensation rules are configured for different ranges, and the corresponding compensation parameters of each range can be obtained by using the test points in each range. In the subsequent compensation, the corresponding compensation parameters are determined according to the gray scale voltage required to be output, and then the compensated gray scale voltages are obtained based on the compensation parameters to drive the pixels to emit light, such that the compensation effect is closer to the actual gamma curve, so as to alleviate the technical problem of uneven display of pixels in the display panel of the prior art and to improve the display effect of the display, for increasing the product yield of the display device and improving the user experience.

For realizing that the display device to switch different gamma curves in different scenarios, the display device provided by the present application further includes a gamma curve adjustment module, and the gamma curve adjustment module is configured for adjusting a gamma curve required by the driving chip to provide a gray scale of video signal according to a brightness change of a display device environment. The display panel shows the video signal image for viewing by the user according to the gray scale of the aforesaid video signal.

In an embodiment, the gamma curve adjustment module includes an ambient light processing unit and a gamma curve adjuster, wherein the ambient light processing unit includes a light sensor and a light amplification processor; first, the light sensor senses the brightness change of the display device environment and outputs a light sensing signal LSS thereby. Then, the light amplification processor amplifies a gain value of the light sensing signal LSS outputted by the light sensor (this gain value should be determined according to the actual situation), and performs optimization process, such as noise filtering and distortion compensation to obtain a brightness signal IS to be outputted to the gamma curve adjuster. Then, after the gamma curve adjuster receives the brightness signal IS, the gamma curve adjuster finds a gamma curve corresponding to the brightness signal according to a built-in lookup table.

In this embodiment, the ambient light processing unit senses the brightness change of the display device environment, and adjusts the gamma value of the gamma curve outputted by the gamma curve adjuster in real time. Therefore, whether the liquid crystal display is in a bright environment or a dark room, the user will feel that the resolution of the color brightness of the liquid crystal display is high, and the displayed picture will become clearer.

It can be known according to the aforesaid embodiment: the present application provides a new driving voltage compensation method, a gray scale compensation method and a display device. In the methods, the driving voltage or the gray scale voltage is divided into a plurality of driving voltage ranges or gray scale voltage ranges which are different. The different compensation rules are configured for different ranges, and the corresponding compensation parameters of each range can be obtained by using the test points in each range. In the subsequent compensation, the corresponding compensation parameters are determined according to the driving voltage or gray scale voltage required to be output, and then the compensated driving voltages or the compensated gray scale voltages are obtained based on the compensation parameters to drive the pixels to emit light, such that the compensation effect is closer to the actual gamma curve, so as to alleviate the technical problem of uneven display of pixels in the display panel of the prior art, for increasing the product yield of the display device and improving the user experience.

In summary, although the above preferred embodiments of the present application are disclosed, the foregoing preferred embodiments are not intended to limit the invention, those skilled in the art can make various kinds of alterations and modifications without departing from the spirit and scope of the present application. Thus, the scope of protection of the present application is defined by the scope of the claims.

What is claimed is:

1. A display panel gray scale compensation method, including:

determining a gamma curve of a display panel, wherein the gamma curve is a corresponding curve of a gray scale voltage and a luminous brightness of the pixel;

dividing the entire range of the gray scale voltage into at least two gray scale voltage ranges according to the gamma curve and determining test points in the respective gray scale voltage ranges; wherein gray scale voltage compensation rules corresponding to different gray scale voltage ranges are different;

determining corresponding brightness values of the gray scale voltages corresponding to the test points in the gamma curve;

obtaining actual gray scale voltages required when the luminous brightness of the pixel reaches the brightness values;

deriving gray scale voltage compensation parameters corresponding to the respective gray scale voltage ranges according to a mapping relationship between the gray scale voltages of the test points in the respective gray scale voltage ranges and the actual gray scale voltages, and the gray scale voltage compensation rules of the gray scale voltage ranges; and compensating the gray scale voltage of the pixel of each of driving voltage ranges according to the gray scale voltage compensation parameters corresponding to the gray scale voltage ranges;

wherein the step of dividing the entire range of the gray scale voltage into at least two gray scale voltage ranges according to the gamma curve includes:

determining a change trend of the gray scale voltage and the luminous brightness corresponding to the gamma curve; and sequentially dividing gray scale voltage into a first gray scale voltage range, a second gray scale voltage range and a third gray scale voltage range in an order from small to large, a gray scale compensation rule corresponding to the first gray scale voltage range is a quadratic function, and a gray scale compensation rule corresponding to the second gray scale voltage range is a linear function, and a gray scale voltage compensation rule corresponding to the third gray scale voltage range is a quadratic function.

2. The display panel gray scale compensation method according to claim 1, wherein the step of compensating the gray scale voltage of the pixel of each of driving voltage ranges according to the gray scale voltage compensation parameters corresponding to the gray scale voltage ranges includes:

determining a theoretical gray scale voltage of the pixel when displaying a next frame image according to a content of the next frame image;

obtaining a belonged gray scale voltage range of the theoretical gray scale voltage;

obtaining an actual gray scale voltage corresponding to the theoretical gray scale voltage according to the gray scale compensation parameter corresponding to the belonged gray scale voltage range; and driving the pixel to emit light according to the actual gray scale voltage.

3. The display panel gray scale compensation method according to claim 1, wherein the step of determining the test points in the respective gray scale voltage ranges includes:

determining a number of compensation coefficients in the gray scale voltage ranges corresponding to the gray scale voltage compensation rules;

determining a number of the test points required according to the number of compensation coefficients; and setting the test points of a corresponding number in the gray scale voltage ranges.

4. The display panel gray scale compensation method according to claim 1, wherein the step of obtaining the actual gray scale voltages required when the luminous brightness of the pixel reaches the brightness values includes:

gradually increasing the gray scale voltage of the pixel, and collecting the luminous brightness of the pixel in real time; and using corresponding gray scale voltages as the actual gray scale voltages required when the luminous brightness of the pixel reaches the brightness values.

5. A display device, including a display panel, a driving chip, a lighting module, a processor and a memory, wherein:

the processor is configured for determining a gamma curve of the display panel, wherein the gamma curve is a corresponding curve of a gray scale voltage and a luminous brightness of a pixel; dividing the entire range of the gray scale voltage into at least two gray scale voltage ranges according to the gamma curve and determining test points in the respective gray scale voltage ranges; determining corresponding brightness values of the gray scale voltages corresponding to the test points in the gamma curve; wherein gray scale voltage compensation rules corresponding to different gray scale voltage ranges are different;

the lighting module is configured for collecting the luminous brightness of the pixel;

the driving chip is configured for driving the pixel in the display panel to emit light;

the processor is further configured for obtaining actual gray scale voltages required when the luminous brightness of the pixel reaches the brightness values; deriving gray scale voltage compensation parameters corresponding to the respective gray scale voltage ranges according to a mapping relationship between the gray scale voltages of the test points in the respective gray scale voltage ranges and the actual gray scale voltages, and the gray scale voltage compensation rules of the gray scale voltage ranges, and storing the same to the memory;

the driving chip is further configured for driving the pixel in the display panel to emit light after compensating the gray scale voltage of the pixel according to the gray scale voltage compensation parameters corresponding to the gray scale voltage ranges; and the memory is configured for storing a program required to implement functions of the processor, the gray scale voltage ranges corresponding to the respective pixels, the gray scale compensation rules corresponding to the respective gray scale voltage ranges and the gray scale compensation parameters in at least one gamma curve;

wherein dividing the entire range of the gray scale voltage into at least two gray scale voltage ranges according to the gamma curve includes:

determining a change trend of the gray scale voltage and the luminous brightness corresponding to the gamma curve; and sequentially dividing gray scale voltage into a first gray scale voltage range, a second gray scale voltage range and a third gray scale voltage range in an order from small to large, a gray scale compensation rule corresponding to the first gray scale voltage range is a quadratic function, and a gray scale compensation rule corresponding to the second gray scale voltage range is a linear function, and a gray scale voltage compensation rule corresponding to the third gray scale voltage range is a quadratic function.

6. The display device according to claim 5, wherein the light module includes a camera.

7. The display device according to claim 6, wherein the camera includes a charge-coupled device camera.

8. The display device according to claim 5, wherein the memory includes a flash memory.

9. The display device according to claim 8, wherein the memory stores a plurality of sets of data corresponding to gamma for each pixel, and each set of data includes scopes of the plurality of gray scale voltage ranges, the gray scale voltage compensation rules corresponding to the respective gray scale voltage ranges and the gray scale voltage compensation parameters.

10. The display device according to claim 5, wherein the display device further includes a gamma curve adjustment module, and the gamma curve adjustment module is configured for adjusting a gamma curve required by the driving chip to provide a gray scale of video signal according to a brightness change of a display device environment.

11. The display device according to claim 10, wherein the gamma curve adjustment module includes an ambient light processing unit and is configured to function as a gamma curve adjuster, and the ambient light processing unit is configured for sensing the brightness change of the display device environment and outputting a brightness signal, and the gamma curve adjuster is configured for finding a gamma curve corresponding to the brightness signal according to a built-in lookup table.

12. The display device according to claim 11, wherein the ambient light processing unit includes a light sensor and a light amplification processor, and the light sensor is configured for sensing the brightness change of the display device environment and outputting a light sensing signal, and the light amplification processor is configured for performing an optimization process on the light sensing signal to obtain the brightness signal.

* * * * *